US010737752B1

(12) United States Patent
Jaszewski

(10) Patent No.: US 10,737,752 B1
(45) **Date of Patent: *Aug. 11, 2020**

(54) OUTBOARD MOTORS HAVING FLEXIBLE CONNECTOR ASSEMBLY FOR SHIFT ACTUATION

(71) Applicant: Brunswick Corporation, Mettawa, IL (US)

(72) Inventor: Wayne M. Jaszewski, Jackson, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/151,425

(22) Filed: Oct. 4, 2018

Related U.S. Application Data

(63) Continuation of application No. 15/681,562, filed on Aug. 21, 2017, now Pat. No. 10,118,683.

(51) Int. Cl.
*B63H 20/20* (2006.01)
*B63H 23/30* (2006.01)
*B63H 23/08* (2006.01)

(52) U.S. Cl.
CPC ..... *B63H 20/20* (2013.01); *B63H 23/30* (2013.01); *B63H 23/08* (2013.01)

(58) Field of Classification Search
CPC ... B63B 35/58; B63B 35/14; B63B 2035/738; B63B 2231/50; B63H 20/20; B63H 23/30; B63H 23/08
See application file for complete search history.

(56) References Cited

U.S. PATENT DOCUMENTS

| | | | | |
|---|---|---|---|---|
| 3,858,101 | A | 12/1974 | Schmiedel et al. | |
| 3,943,790 | A | 3/1976 | Meyer | |
| 4,223,773 | A | 9/1980 | Croisant et al. | |
| 4,231,316 | A | 11/1980 | Bland et al. | |
| 4,262,622 | A * | 4/1981 | Dretzka | B63H 21/213 440/1 |
| 4,403,970 | A * | 9/1983 | Dretzka | F02B 61/045 123/335 |
| 4,753,618 | A | 6/1988 | Entringer | |
| 5,403,218 | A * | 4/1995 | Onoue | B63H 20/002 192/48.91 |
| 6,093,066 | A | 7/2000 | Isogawa | |
| 6,544,083 | B1 | 4/2003 | Sawyer et al. | |

(Continued)

*Primary Examiner* — Anthony D Wiest
(74) *Attorney, Agent, or Firm* — Andrus Intellectual Property Law, LLP

(57) ABSTRACT

An outboard motor is for propelling a marine vessel in water. The outboard motor has an upper cowling that covers an internal combustion engine, a driveshaft housing located below the internal combustion engine, and a lower gearcase located below the driveshaft housing. The lower gearcase encloses a transmission gearset configured to transmit power from the internal combustion engine to a propulsor. A shift actuator is covered by the upper cowling and a shift mechanism is located at least partially in the lower gearcase and configured to shift the transmission gearset into and between forward, neutral and reverse gears. A flexible connector assembly operatively couples the shift actuator to the shift mechanism so that actuation of the shift actuator causes the shift mechanism to shift the transmission gearset.

13 Claims, 5 Drawing Sheets

(56) References Cited

U.S. PATENT DOCUMENTS

| | | | | |
|---|---|---|---|---|
| 6,884,131 | B2 | 4/2005 | Katayama et al. | |
| 7,291,048 | B1 | 11/2007 | Phillips et al. | |
| 7,297,036 | B1 | 11/2007 | Weronke et al. | |
| 7,544,110 | B1 | 6/2009 | Phillips et al. | |
| 7,632,161 | B1 | 12/2009 | Waldvogel et al. | |
| 7,931,513 | B2 | 4/2011 | Suzuki et al. | |
| 7,997,398 | B1 | 8/2011 | Phillips et al. | |
| 8,020,684 | B2 | 9/2011 | Misao | |
| 8,439,800 | B1 | 5/2013 | Bazan et al. | |
| 9,216,642 | B2 | 12/2015 | Friedmann | |
| 9,260,170 | B2 | 2/2016 | Kubo et al. | |
| 2008/0102718 | A1 | 5/2008 | Hikosaka | |
| 2008/0115712 | A1* | 5/2008 | Hiroshima ..... | B63H 21/213<br>114/144 RE |
| 2008/0268726 | A1 | 10/2008 | Akuzawa | |

* cited by examiner

OUTBOARD MOTORS HAVING FLEXIBLE CONNECTOR ASSEMBLY FOR SHIFT ACTUATION

CROSS REFERENCE TO RELATED APPLICATION

The present application is a continuation of U.S. application Ser. No. 15/681,562, filed Aug. 21, 2017, which application is hereby incorporated by reference in its entirety.

FIELD

The present disclosure relates to outboard motors and more particularly to apparatuses for shifting a transmission in an outboard motor.

BACKGROUND

The following patents are incorporated herein by reference in entirety: U.S. Pat. No. 8,439,800 discloses a shift control system for a marine drive, which applies partial clutch engagement pressure upon initial shifting from forward to reverse to prevent stalling of the engine otherwise caused by applying full clutch engagement pressure upon shifting from forward to reverse.

U.S. Pat. No. 7,997,398 discloses a marine transmission having a cylindrical spool valve that is disposed within the gearcase of the transmission and having a movable portion that is axially movable in a vertical direction to select forward, neutral, and reverse gear positions of the transmission. A piston assembly provides a primary piston and two auxiliary pistons which cooperate with each other to provide appropriate hydraulic forces which move a dog clutch into engagement with forward or reverse gears or toward a location in non-engagement with neither the forward nor reverse gears. The spool valve is generally cylindrical and disposed within a narrow column portion of the gearcase of a marine propulsion system.

U.S. Pat. No. 7,544,110 discloses an actuator for a marine transmission that uses four cavities of preselected size to provide four potential forces resulting from pressurized hydraulic fluid within those cavities. The effective areas of surfaces acted upon by the hydraulic pressure are selected in order to provide increased force to move the actuator toward a neutral position from either a forward or reverse gear position. Also, the relative magnitudes of these effective areas are also selected to provide a quicker movement into gear than out of gear, given a similar differential magnitude of pressures within the cavities.

U.S. Pat. No. 7,297,036 discloses a marine transmission wherein trailing faces of each of a plurality of gear projections extend axially from a forward gear are provided with a rake angle. This rake angle of each trailing face cooperates with an associated surface of each of a plurality of clutch projections to retain a dog clutch in an axial position relative to the forward gear even during periods when a marine vessel is rapidly decelerating and, as a result, the dog clutch moves into driving relation with the forward gear.

U.S. Pat. No. 7,291,048 discloses an actuator of a marine propulsion transmission that is attached to a movable clutch member through the use of a coupler which comprises a generally spherical member formed as a portion of the actuator and a chuck device formed as part of the clutch member. The generally spherical member, or alternatively shaped component, is received by the chuck device and retained therein. The components are configured to allow relative rotation between the actuator and the clutch member while causing them to move axially in synchrony with each other.

U.S. Pat. No. 6,544,083 discloses a gear shift mechanism in which a cam structure comprises a protrusion that is shaped to extend into a channel formed in a cam follower structure. The cam follower structure can be provided with first and second channels that allow the protrusion of the cam to be extended into either which accommodates both port and starboard shifting mechanisms. The cam surface formed on the protrusion of the cam moves in contact with a selected cam follower surface formed in the selected one of two alternative channels to cause the cam follower to move axially and to cause a clutch member to engage with either a first or second drive gear.

U.S. Pat. No. 4,223,773 discloses a clutch apparatus for a marine drive lower gearcase, which includes a propeller shaft rotatably mounted in a gearcase housing. A drive gear for both forward and reverse is positioned in the housing coaxial with the propeller shaft and a clutch member is rotatably fixed on the propeller shaft and movable axially into drive engagement with the drive gear. Clutch engaging elements are provided on opposed portions of the drive gears and the clutch member. Shift means utilizing a positive acting cam means positively move the clutch member into and out of engagement from the drive gears. The shift means also include a releasable latch means to positively maintain the shift means in the engaged position and a preloading means between the shift means and the clutch member to snap the clutch member into engagement.

U.S. Pat. No. 3,943,790 discloses a marine outboard gear assembly, usable in an outboard motor or an inboard-outboard drive, and featuring (a) constant drive of the meshing gears which transfer power to the propeller-shaft axis, and (b) selective spring-clutching direct to the propeller shaft, thereby (c) utilizing the meshing gears for lubricant circulation as long as the engine is operating and whether or not the clutch is engaged and (d) reducing to an absolute minimum the drag and inertial effects operative upon the propeller shaft when the boat is moving in the declutched condition, i.e., propeller windmilling. Also featured is a particular subassembly of gear and clutch parts on the propeller shaft whereby desired axial clearance can be readily pre-adjusted and selected, prior to assembly to the gearcase.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

An outboard motor is for propelling a marine vessel in water. The outboard motor has an upper cowling that covers an internal combustion engine, a driveshaft housing located below the internal combustion engine, and a lower gearcase located below the driveshaft housing. The lower gearcase encloses a transmission gearset configured to transmit power from the internal combustion engine to a propulsor. A shift actuator is covered by the upper cowling and a shift mechanism is located at least partially in the lower gearcase and is configured to shift the transmission gearset into and between forward, neutral and reverse gears. A flexible connector assembly operatively couples the shift actuator to the shift mechanism so that actuation of the shift actuator causes the shift mechanism to shift the transmission gearset.

BRIEF DESCRIPTION OF THE DRAWINGS

The present disclosure is described with reference to the following figures. The same numbers are used throughout the figures to reference like features and like components.

DETAILED DESCRIPTION OF THE DRAWINGS

Figure 1:
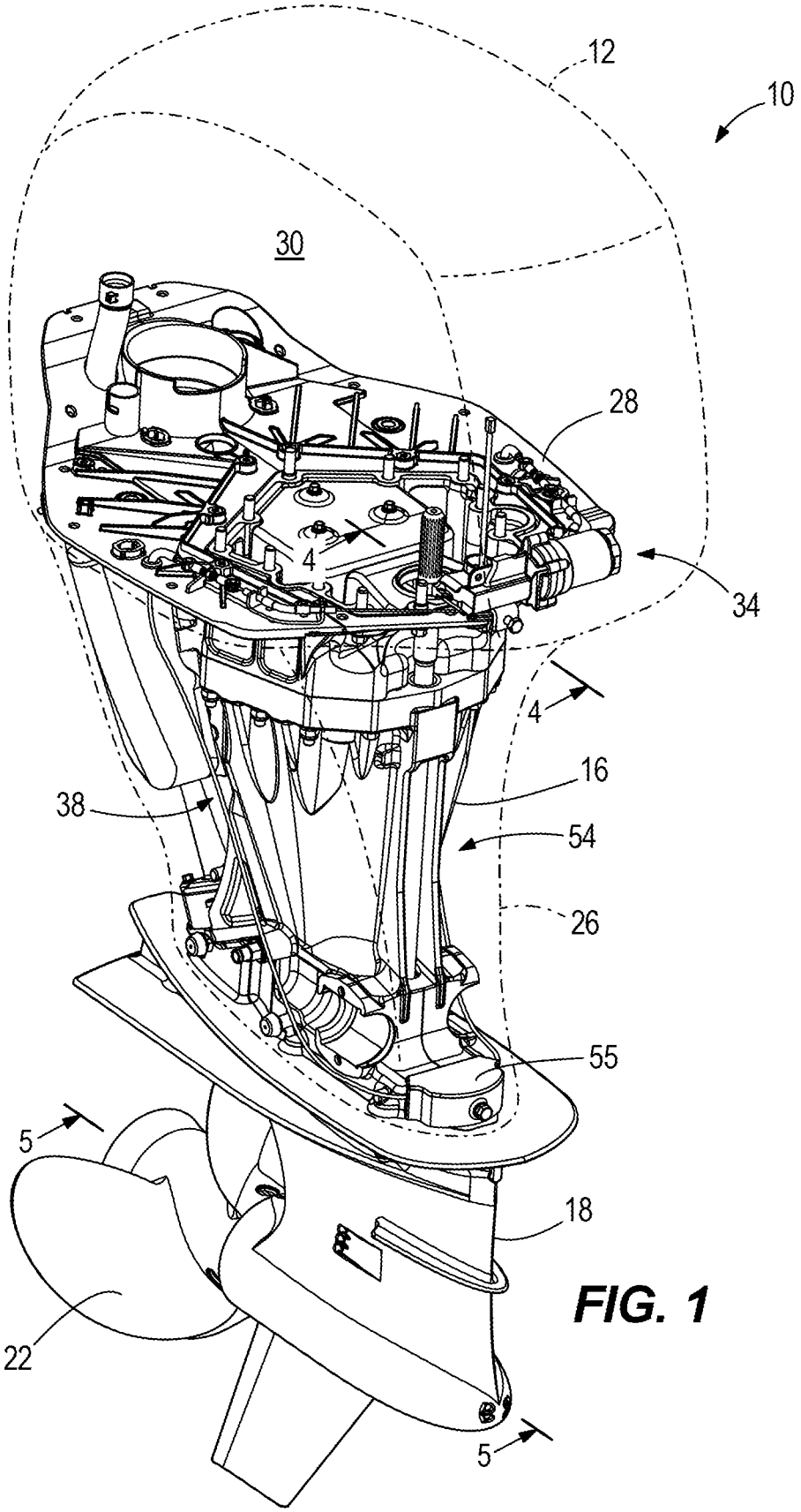
FIG. 1 is a perspective view of an outboard motor according to the present disclosure.
Figure 2:
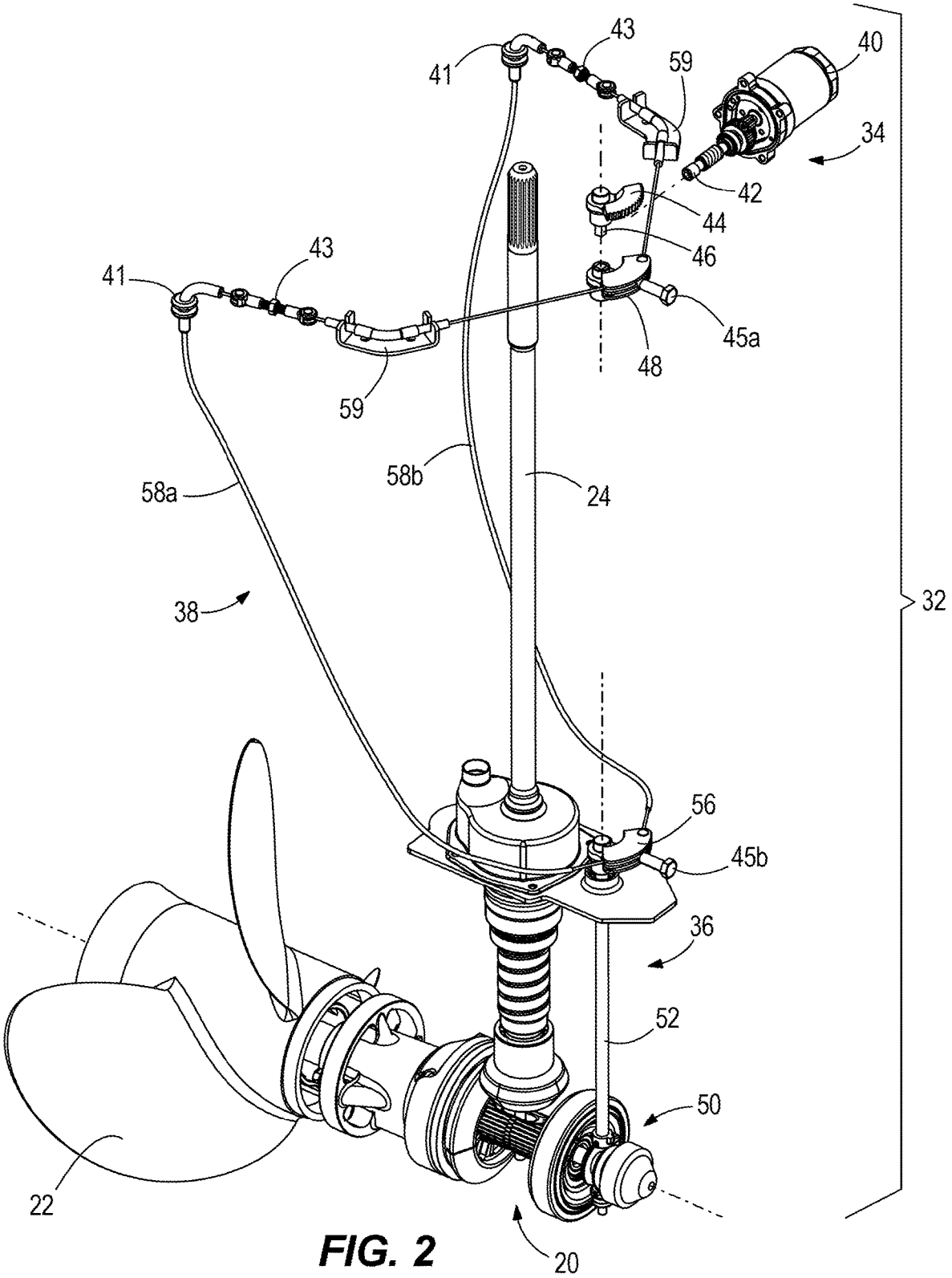
FIG. 2 is a partial view of a drivetrain for the outboard motor, along with a shift assembly according to the present disclosure.

FIG. 1 depicts an exemplary outboard motor 10 according to the present disclosure. As is conventional, the outboard motor 10 has an upper cowling 12 that covers a not-shown internal combustion engine, a driveshaft housing 16 located below the internal combustion engine, and a lower gearcase 18 located below the driveshaft housing 16. Referring to FIG. 2, the lower gearcase 18 encloses a transmission gearset 20 that is configured to transmit power from the internal combustion engine to a propulsor, which in this example is a propeller 22 configured to impart a propulsive force on the water in which the outboard motor 10 is operating. As is conventional, the internal combustion engine causes rotation of a driveshaft 24 that extends downwardly through the driveshaft housing 16 and into the lower gearcase 18. The driveshaft 24 is connected to the propeller 22 via the transmission gearset 20. A lower cowling 26 covers the driveshaft housing 16. An adapter plate 28 supports the internal combustion engine. Together, the upper cowling 12 and the adapter plate 28 define a sealed powerhead compartment 30, which protects its contents from the environment, including e.g. water, and from collision with other objects.

Through research and experimentation, the present inventor has realized that design space within outboard motors is limited. Further, the inventor has found it to be desirable to place sensitive components in the sealed powerhead compartment 30 so as to avoid damage from environmental elements and/or collision with other objects. More specifically, through research and experimentation, the present inventor has determined that traditional outboard motors utilize a rigid shift shaft that extends from the lower gearcase up through a majority of the driveshaft housing. The rigid shift shaft typically extends through a cylindrical passageway in the steering swivel bracket and thus limits the design options for the swivel bracket. For example, it can be difficult to fit the elongated shift shaft in available design space, especially in arrangements where the cylindrical passageway is not inline with the connection point for the shift shaft in the lower gearcase. The concepts described herein below are the result of the present inventor's endeavors to remedy these drawbacks in the prior art. Advantageously the concepts described herein below allow the designer of the outboard motor more freedom to locate the steering axis offline with respect to the shift shaft connection point in the lower gearcase. The following concepts also advantageously protect sensitive shift actuator components from damage due to collision and/or from environmental elements.

Referring to FIGS. 1 and 2, the outboard motor 10 according to the present disclosure includes a shift assembly 32 that is configured to cause a gear change in the transmission gearset 20, thus affecting the direction of rotation of the propeller 22 and the direction of thrust output by the outboard motor 10. The shift assembly 32 includes a shift actuator 34 that is located in the sealed powerhead compartment 30 and covered by the upper cowling 12. The shift assembly 32 also includes a shift mechanism 36 that is located at least partially in the lower gearcase 18 and configured to shift the transmission gearset 20 into and between forward, neutral, and reverse gears. The shift assembly 32 further includes a flexible connector assembly 38 that operatively couples the shift actuator 34 to the shift mechanism 36 so that actuation of the shift actuator 34 causes commensurate actuation of the shift mechanism 36, so as to shift the transmission gearset 20 as described herein above.

Figure 3:
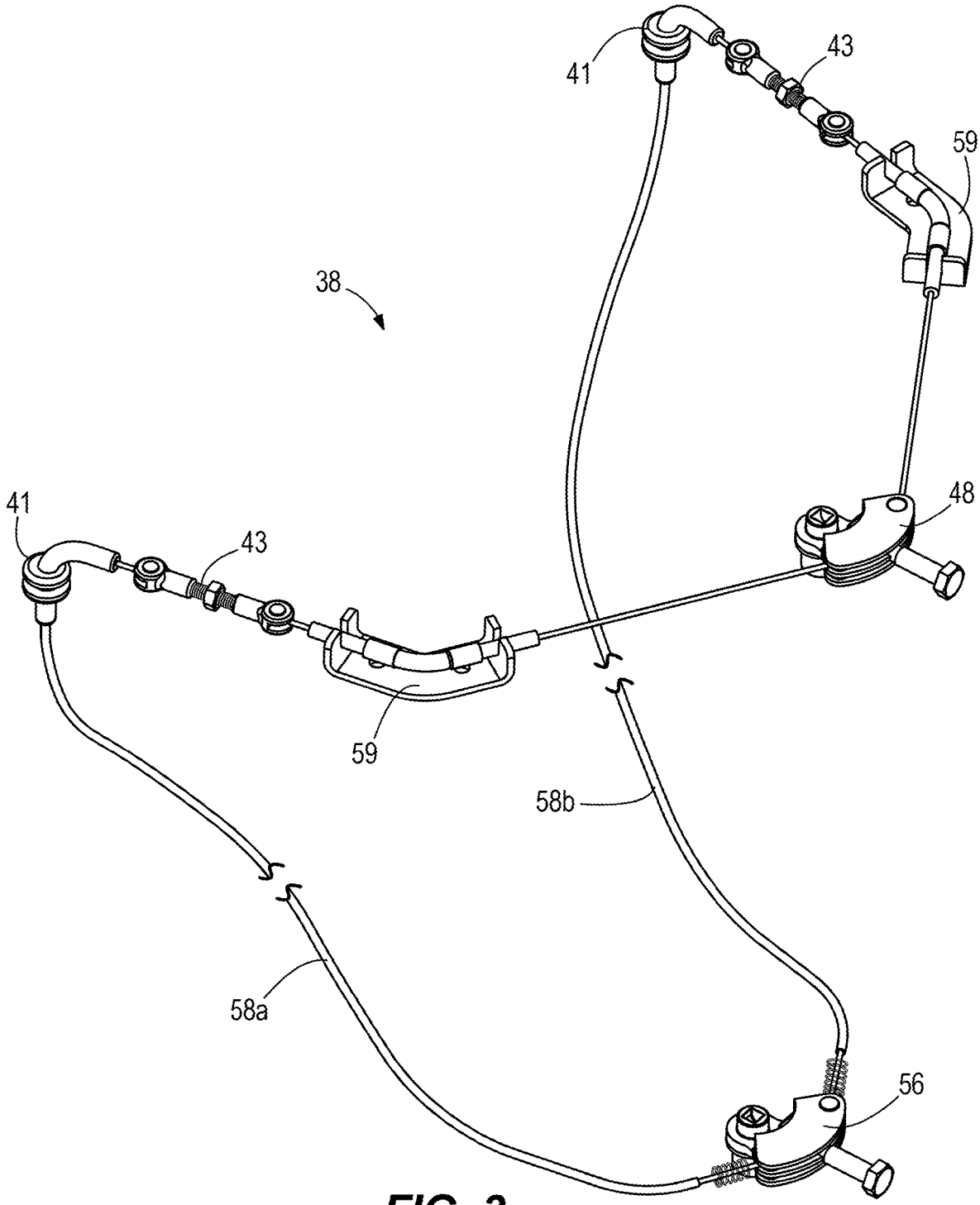
FIG. 3 is an isolated view of a flexible connector assembly associated with the shift assembly.
Figure 4:
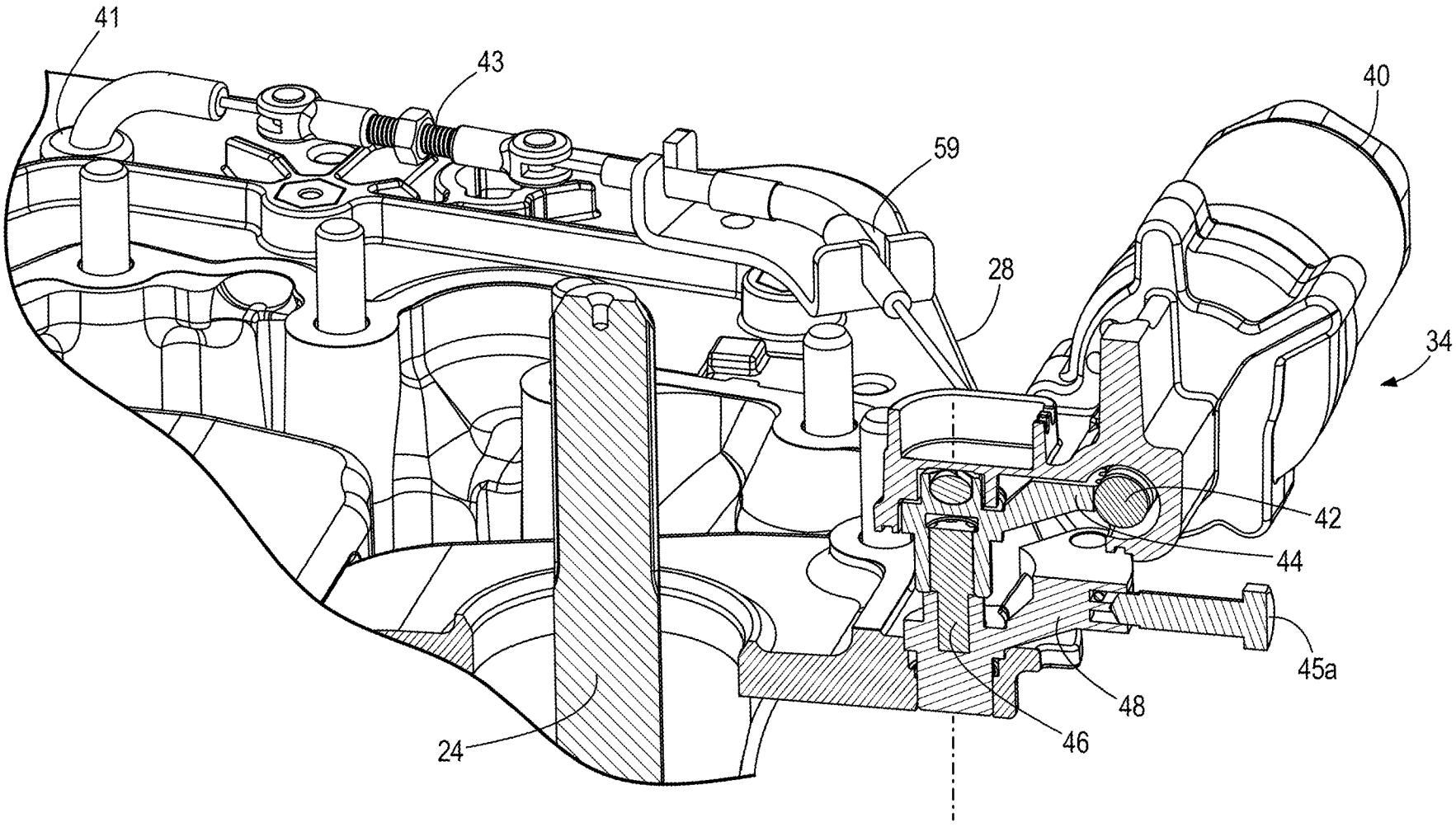
FIG. 4 is a view of section 4-4, taken in FIG. 1.

Referring to FIGS. 2-4, the shift actuator 34 includes a motor 40. Operation of the motor 40 causes rotation of the motor's output shaft 42. The output shaft 42 is geared with a sector gear 44, which is pivotable with an output pin 46. Rotation of the output shaft 42 by the motor 40 causes commensurate rotation of the sector gear 44, which thereby causes rotation of the output pin 46 about its own axis. The output pin 46 is coupled to an upper rotary member 48 such that rotation of the output pin 46 causes commensurate rotation of the upper rotary member 48. In one example, the motor 40 is a bidirectional electric motor, which can rotate clockwise and counter clockwise based upon an electrical input signal from a (not shown) computer controller. However the type and configuration of the motor 40 can vary from what is shown and described. Operation of the motor 40 in a first direction causes rotation of the output shaft 42 in a first direction, which causes rotation of the sector gear 44 in a first direction, which causes rotation of the output pin 46 and lower rotary member 56 in a first direction. Operation of the motor 40 in an opposite, second direction, causes rotation of the output shaft 42 in a second direction, which causes rotation of the sector gear 44 in a second direction, which causes rotation of the output pin 46 and upper rotary member 48 in a second direction.

Figure 5:
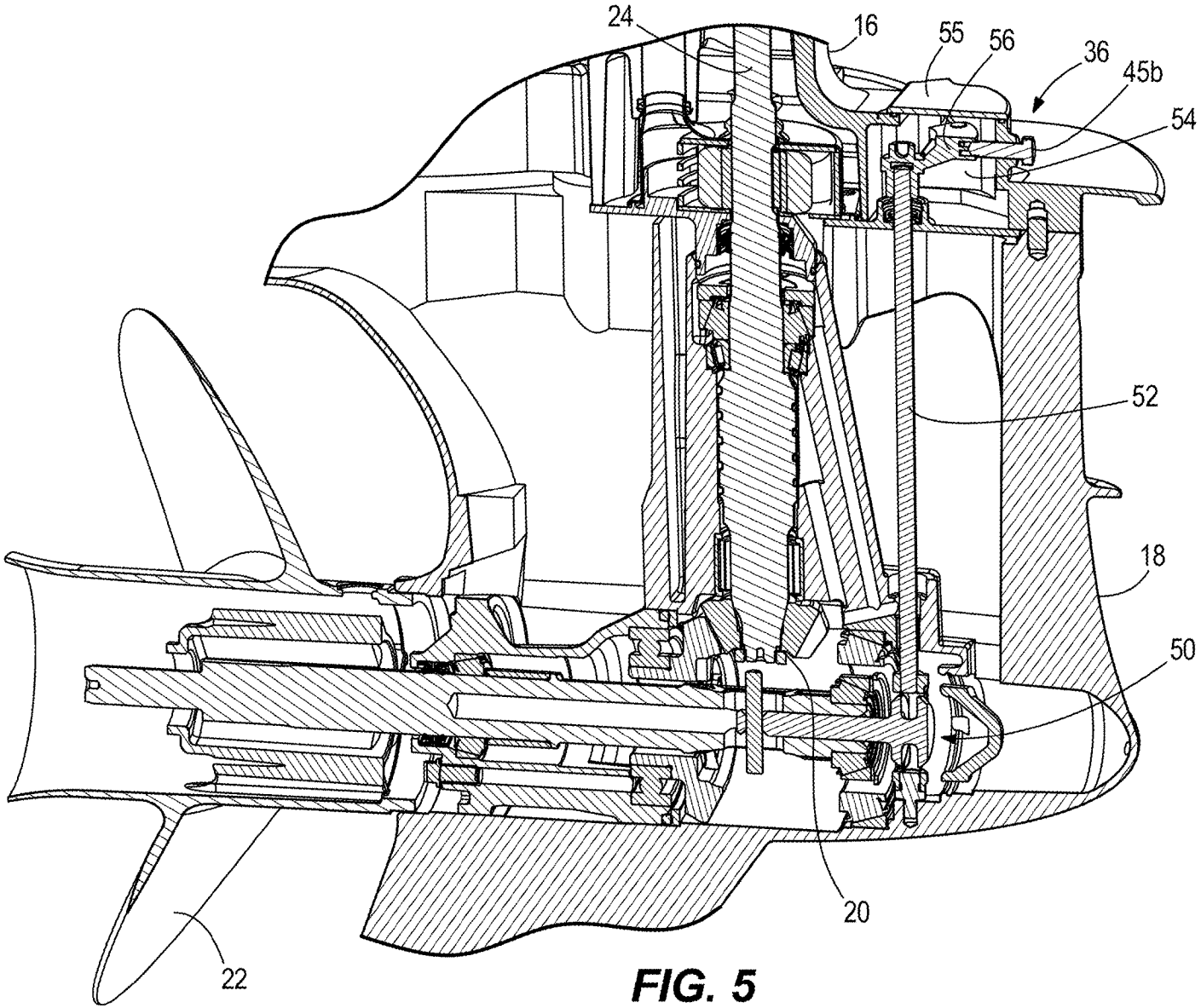
FIG. 5 is a view of section 5-5, taken in FIG. 1.

Referring to FIGS. 2 and 5 the shift mechanism 36 can include a conventional clutch 50 (for example a dog clutch or other type of clutch) located in the lower gearcase 18 and configured to shift the transmission gearset 20 into and between forward, neutral, and reverse gears. Suitable clutch mechanisms (including e.g. dog clutches, cone clutches, etc.) are well known in the art, and examples are provided in the above-incorporated U.S. patents. Actuation of the clutch 50 is caused by rotation of a conventional rigid shift shaft 52 that extends upwardly from the clutch 50 in the lower gearcase 18 into a cavity 54 (see FIG. 1) between the lower cowling 26 and the driveshaft housing 16. A lower rotary member 56 that is constructed similar to the upper rotary member 48 is coupled to the top of the shift shaft 52 such that rotation of the lower rotary member 56 causes commensurate rotation of the shift shaft 52. Thus, it will be seen that the shift mechanism 36, including the clutch 50, shift shaft 52 and lower rotary member 56 is partially located in the lower gearcase 18 and also partially located in the cavity 54 between the lower cowling 26 and the driveshaft housing 16. As shown in FIG. 1 an optional cover 55 can be located over the lower rotary member 56, protecting it from damage due to water, collision, etc.

Referring to FIGS. 1-3, the flexible connector assembly 38 extends from the shift actuator 34 to the shift mechanism 36 via the cavity 54 between the lower cowling 26 and the driveshaft housing 16. In the illustrated example, the flexible connector assembly 38 includes one or more flexible cables 58 (e.g. 58*a*, 58*b*) that follow a circuitous path through the outboard motor 10 from the shift actuator 34 to the shift mechanism 36. In particular, the flexible connector assembly 38 extends from the shift actuator 34 in the sealed powerhead compartment 30, out of the sealed powerhead compartment 30 and into the cavity 54 between the lower cowling 26 and the driveshaft housing 16, and downwardly in the cavity 54 to the shift mechanism 36. The flexible connector assembly 38 extends from the sealed powerhead compartment 30 and to the cavity 54 through the adapter plate 28. Specifically, a flexible cable 58*a* is connected at one end to the upper rotary member 48 on the shift actuator 34 and at an opposite end to the lower rotary member 56 on the shift mechanism 36. The cable 58*a* can consist of one elongated length of cable or consist of several cable sections connected together in series. The cable 58*a* is guided along a top surface of the adapter plate 28 by an anchor bracket 59 and then extends down through the adapter plate 28 via a sealed through-hole fitting 41. Optionally, a cable adjustment turnbuckle 43 can be included along the cable 58*a*, optionally in the sealed powerhead compartment 30, allowing for adjustment of the overall length of the cable 58*a*, for example during installation. Although not shown, a series of cable hold-down clips can be included along the cable 58*a*, for example to hold the cable 58*a* in place along the circuitous path in the cavity 54. Optionally, the cable 58*a* includes an over-cable shielding, for example made of rubber, to protect the cable 58*a* from damage.

Another flexible cable 58*b* is connected at one end to the upper rotary member 48 on the shift actuator 34 and at an opposite end to the lower rotary member 56 on the shift mechanism 36. Similar to the cable 58*a*, the cable 58*b* is guided along the top surface of the adapter plate 28 by an anchor bracket 59 and then extends down through the adapter plate 28 via a sealed through-hole fitting 41. The cable 58*b* can consist of one elongated length of cable or consist of several cable sections connected together in series. Optionally, a cable adjustment turnbuckle 43 can be included with the flexible cable 58*b*, allowing for adjustment of the overall length of the cable 58*b*, for example during installation. Although not shown, a series of cable hold-down clips can be included along the cable 58*a* to hold the cable 58*a* in place, for example along the circuitous path in the cavity 54. Optionally, the cable 58*b* includes an over-cable shielding, for example made of rubber, to protect the cable 58*b* from damage. Cable adjustment/centering bolts 45*a*, 45*b* can be included with the upper and lower rotary members 48, 56 for centering the respective flexible connector assembly 38, for example during installation.

In use, an operator inputs a request to change gears in the transmission gearset 20, via for example an input device associated with the (not shown) controller or any other type of input device. In response, the motor 40 causes the output shaft 42 to rotate, which as explained herein above rotates the upper rotary member 48. Rotation of the upper rotary member 48 pulls on one side of the flexible connector assembly 38, and thus causes rotation causes commensurate rotation of the lower rotary member 56 and causes the shift mechanism 36 to shift the transmission gearset 20, all as described herein above. Opposite rotation of the output shaft 42 by the motor 40 causes opposite rotation of the output shaft 42, which as explained herein above oppositely rotates the upper rotary member 48. This pulls on the other side of the flexible connector assembly 38. In particular, the flexible connector assembly 38 includes a pull-pull cable loop having first and opposite second sides 58*a*, 58*b* that extend from the upper rotary member 48 to the lower rotary member 56. Thus, forwardly rotating the upper rotary member 48 pulls on the first side 58*a* of the pull-pull cable loop, which forwardly rotates the lower rotary member 56, thereby causing the shift mechanism 36 to shift the transmission gearset 20 into or out of gear, depending upon its current gear state. This further pulls on the opposite, second side 58*b* of the pull-pull cable loop, thereby assisting forward rotation of the upper rotary member 48. Oppositely rotating the upper rotary member 48 pulls on the opposite, second side 58*b* of the pull-pull cable loop, which reversely rotates the lower rotary member 56, thereby causing the shift mechanism 36 to shift the transmission gearset 20 into or out of gear, depending on the current gear state. This pulls on the first side 58*b* of the pull-pull cable loop, thereby assisting reverse rotation of the upper rotary member 48. Optionally, a sensor can be included to sense an operational state of the flexible connector assembly 38 and alert an operator regarding an error state.

In the present description, certain terms have been used for brevity, clarity and understanding. No unnecessary limitations are to be inferred therefrom beyond the requirement of the prior art because such terms are used for descriptive purposes only and are intended to be broadly construed. The different apparatuses, systems, and methods described herein may be used alone or in combination with other apparatuses, systems, and methods. Various equivalents, alternatives and modifications are possible within the scope of the appended claims.

What is claimed is:

1. An outboard motor for propelling a marine vessel in water, the outboard motor comprising:

a powerhead;

an upper cowling covering the powerhead;

a driveshaft housing located below the powerhead;

an adapter plate located between the powerhead and the driveshaft housing, wherein the upper cowling and adapter plate together define a sealed powerhead compartment;

a lower gearcase located below the driveshaft housing and enclosing a transmission configured to transmit power from the powerhead to a propulsor;

a shift actuator located in the sealed powerhead compartment and being accessible upon removal of the upper cowling;

a shift mechanism located at least partially in the lower gearcase and configured to shift the transmission into and between forward, neutral and reverse gears;

a flexible connector assembly comprising a pull-pull cable loop that operatively couples the shift actuator to the shift mechanism so that actuation of the shift actuator causes the shift mechanism to shift the transmission; and an upper rotary member mounted on the adapter plate, the upper rotary member coupling the shift actuator to the flexible connector assembly such that operation of the shift actuator rotates the upper rotary member, which thereby pulls on the flexible connector assembly and causes the shift mechanism to shift the transmission.

2. The outboard motor according to claim 1, wherein the pull-pull cable loop has first and opposite, second sides extending from the upper rotary member along first and opposite, second sides of the powerhead, respectively.

3. The outboard motor according to claim 2, wherein the upper rotary member rotates about an upper rotary member axis that extends transversely with respect to the adapter plate, and wherein the first and opposite, second sides of the pull-pull cable loop extend transversely from the upper rotary member axis, along an upper surface of the adapter plate and then downwardly through the adapter plate.

4. The outboard motor according to claim 3, wherein the first and second sides of the pull-pull cable loop further extend downwardly from the adapter plate, towards each other and towards the shift mechanism.

5. The outboard motor according to claim 4, wherein forwardly rotating the upper rotary member pulls on the first side of the pull-pull cable loop, which thereby causes the shift mechanism to shift the transmission into the forward gear, and which further pulls on the opposite, second side of the pull-pull cable loop, thereby assisting forward rotation of the upper rotary member.

6. The outboard motor according to claim 5, wherein reversely rotating the upper rotary member pulls on the second side of the pull-pull cable loop, which thereby causes the shift mechanism to shift the transmission into reverse gear, and which further pulls on the opposite, second side of the pull-pull cable loop, thereby assisting reverse rotation of the upper rotary member.

7. The outboard motor according to claim 4, further comprising a lower cowling covering the driveshaft housing, wherein the flexible connector assembly extends from the shift actuator to the shift mechanism through a cavity between the lower cowling and the driveshaft housing.

8. The outboard motor according to claim 7, further comprising a lower rotary member on the shift mechanism, wherein the flexible connector assembly is connected to the lower rotary member, and wherein the shift actuator rotates the upper rotary member, which pulls on the flexible connector assembly and thereby rotates the lower rotary member, thereby causing the shift mechanism to shift the transmission.

9. The outboard motor according to claim 8, wherein the lower rotary member is located in the cavity between the lower cowling and the driveshaft housing.

10. The outboard motor according to claim 9, wherein the lower rotary member rotates about a lower rotary member axis that is parallel to the upper rotary member axis.

11. The outboard motor according to claim 1, wherein the shift actuator comprises an electric motor that rotates the upper rotary member.

12. The outboard motor according to claim 11, wherein the electric motor comprises a bi-directional electric motor.

13. An outboard motor for propelling a marine vessel in water, the outboard motor comprising:

a powerhead;

an upper cowling covering the powerhead;

a driveshaft housing located below the powerhead;

an adapter plate located between the powerhead and the driveshaft housing, wherein the upper cowling and adapter plate together define a sealed powerhead compartment;

a lower gearcase located below the driveshaft housing and enclosing a transmission configured to transmit power from the powerhead to a propulsor;

a shift actuator located in the sealed powerhead compartment and being accessible upon removal of the upper cowling, wherein the shift actuator is mounted to the adapter plate;

a shift mechanism located at least partially in the lower gearcase and configured to shift the transmission into and between forward, neutral and reverse gears;

a flexible connector assembly comprising a pull-pull cable loop that operatively couples the shift actuator to the shift mechanism so that actuation of the shift actuator causes the shift mechanism to shift the transmission; and an upper rotary member mounted on the adapter plate, the upper rotary member coupling the shift actuator to the flexible connector assembly such that operation of the shift actuator rotates the upper rotary member, which thereby pulls on the flexible connector assembly and causes the shift mechanism to shift the transmission.

* * * * *